US006176154B1

(12) United States Patent
Brucart Puig et al.

(10) Patent No.: US 6,176,154 B1
(45) **Date of Patent: *Jan. 23, 2001**

(54) MANUALLY OPERATED CORKSCREW WITH GRADUATED SUPPORT POINT DESCRIPTION

(76) Inventors: Ramon Brucart Puig; Marta Bonich Linares, both of Gustavo Beequer, 105, Sabadell (Barcelona) 08206 (ES)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/064,733

(22) Filed: Apr. 23, 1998

(30) Foreign Application Priority Data

Apr. 23, 1997 (ES) ..... 9701089

(51) Int. Cl.[7] ..... B67B 7/04
(52) U.S. Cl. ..... 81/3.47; 81/3.09; 81/3.37
(58) Field of Search ..... 81/3.47, 3.09, 81/3.35, 3.36, 3.37, 3.29, 3.55, 3.56, 3.57, 3.48

(56) References Cited

U.S. PATENT DOCUMENTS 4,437,359 * 3/1984 Dejoux et al. ..... 81/3.09

* cited by examiner

*Primary Examiner*—D. S. Meislin
(74) *Attorney, Agent, or Firm*—Michael J. Striker

(57) ABSTRACT

A manually operated corkscrew for removing a stopper from a mouth of a bottle is described. The corkscrew includes a body and a support arm, with an edge, pivotally connected to the body. A ringlet, for removable insertion into the stopper, is pivotally connected to the body adjacent to where the body and support arm are pivotally connected. A mechanism, providing at least two intermediate and graduated points along the edge of the support arm for engagement with the mouth of the bottle to permit removal of the stopper without having to further insert the ringlet into the stopper is also provided.

5 Claims, 2 Drawing Sheets

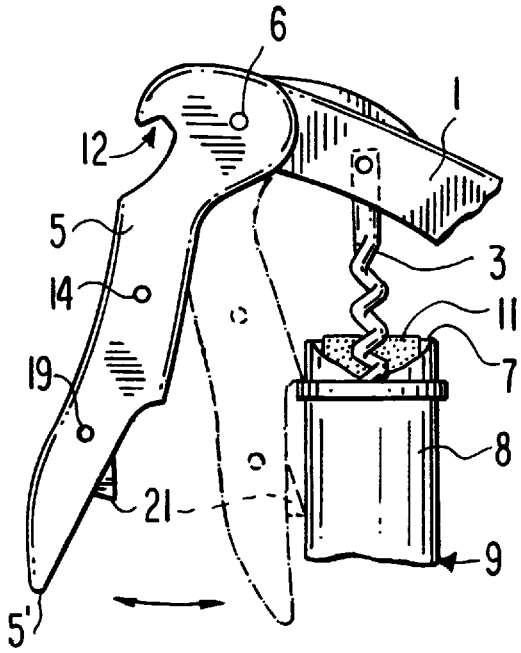
FIG. 4
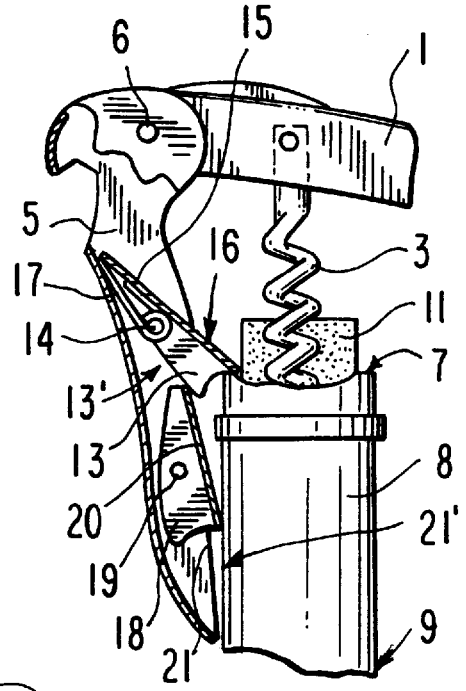
FIG. 5
FIG. 6
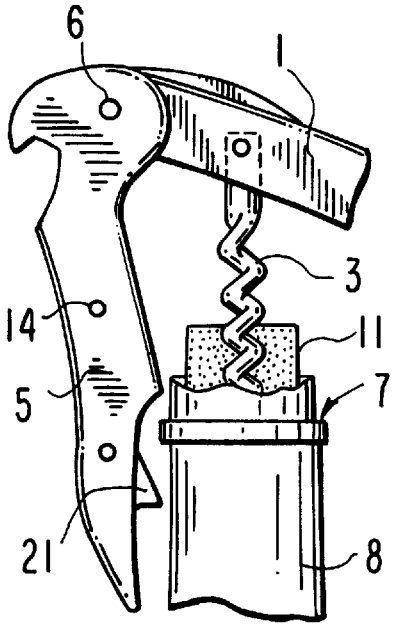
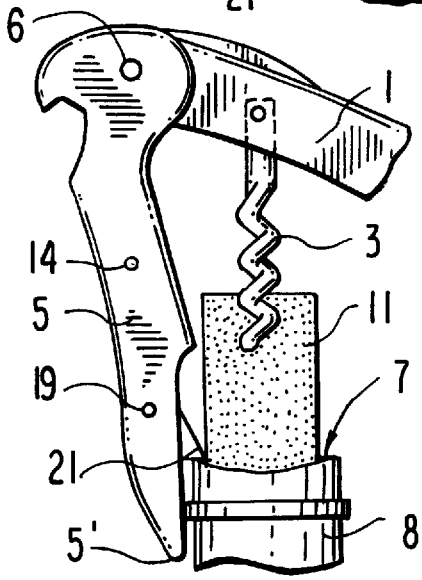
FIG. 7

MANUALLY OPERATED CORKSCREW WITH GRADUATED SUPPORT POINT DESCRIPTION

FIELD OF THE INVENTION

The present invention consists of a corkscrew, designed for the extraction of cork stoppers from bottles, which is manually operated with a lever-type extracting action.

BACKGROUND OF THE INVENTION

It is always necessary, in working with customers in all types of service in restaurants or refreshment establishments, to provide waiters and other staff with tools and utensils which, occupying minimum space, allow them to carry out specific tasks correctly and simply, as is the case with the clean extraction of cork stoppers, as indicated hereinbefore.

There are different types of corkscrews, which are already sufficiently well known and widely used. One of these types has a spike in the form of a ringlet that may be introduced by means of rotation into the stopper to be extracted, followed by an action in the stopper's direction of exit, which action is possible thanks to the lever arm to which the "ringlet" is attached. This action is completed by the provision of an adequate and sufficient point of support upon the edge of the mouth of the bottle itself, which has become the type of corkscrew already known, that is, the type that consists of a second class lever, with the resistance located in the middle area and the point of support at one end.

However, this type of corkscrew has the drawback that, in practice, when carrying out the extraction operation by raising the lever in the direction of exit of the stopper, the length of the arm from the point of support is insufficient to allow the whole stopper to be extracted, so that the operation has to be started again, introducing the "ringlet" further into the partly extracted stopper, which enables the support arm to finish the extraction.

SUMMARY OF THE INVENTION

The present invention is characterized essentially in that it features a multiple and graduated point of support. Consequently, the corkscrew that is the object of the present invention is designed to be able to extract a cork stopper that is forcefully and entirely introduced into the mouth of the bottle without breaking the stopper itself or the edges of the mouth of the bottle, both of which eventualities have an unfavorable influence on the serving of liquid contained in the bottle.

All of this is adequately resolved by applying a corkscrew with a graduated point of support, the object of the present utility model, which is equipped with a simple and easily operated mechanism that allows different points of support upon the mouth of the bottle to be used as the stopper is being extracted, so that it is not necessary to introduce the "ringlet" further into the stopper.

In order to be able to describe in every detail the features of the corkscrew that is the object of the present invention, this specification is accompanied by drawings in which, by way of a non-restrictive practical example, an embodiment of the corkscrew referred to is represented.

BRIEF DESCRIPTION OF THE DRAWINGS

In the drawings:

FIG. 4 illustrates the first sequence of the extraction operation, with the "ringlet" introduced into the interior of the stopper, the support point arm unfolded and, in sketched lines, the arm located next to the mouth of the bottle.

FIG. 5 is a partial view, duly sectioned, showing the position of the support arm, using the first of these, supported upon the flange of the bottle's mouth, and showing the beginning of the extraction operation;

FIG. 6 shows the continuation of the extraction operation, at the moment in which the first point of support is abandoned and the second point of support is situated on the flange of the bottle's mouth; and FIG. 7 illustrates the extraction operation with the second point of support on the flange of the bottle's mouth.

DESCRIPTION OF THE PREFERRED EMBODIMENTS

Figure 1:
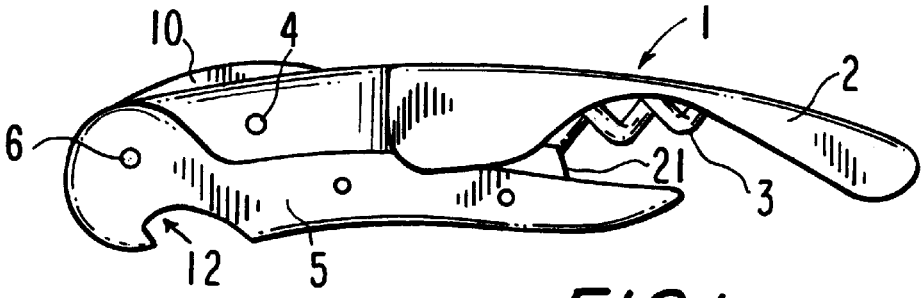
FIG. 1 is a side view of the folded corkscrew.

The structural details, as well as the characteristics of the different elements that make up the corkscrew are described hereinafter in this specification.

Following the drawings; it may be observed that this manually operated corkscrew with a graduated point of support (1) is made up of a main arm (2) which, acting like a body, holds in its middle part the spike in the form of a ringlet screw, or corkscrew (3), which is foldable around the supporting axis (4).

At the end of the body (2) the support arm (5) is situated, which is also foldable upon its supporting axis (6); the end of this arm is shaped like a claw (5') suitable for resting against the flange (7) of the bottle's (9) mouth (8).

In the upper part of the body (2) there is an auxiliary blade (10), already known, which may be folded upon the said supporting axis (6), to be used for tearing the cap that covers the bottle's mouth and also the upper side of the cork stopper to be extracted (11).

The support arm (5) has an auxiliary outer socket (12), of known use, which is for opening bottles fitted with a stopper of the type known as a "crown cap or bottle cap".

The concave curvature of the outer side of the support arm (5) is to be noted, as shown in the different drawings, coinciding in its development with the curvature of the upper outer side of the body (2), which gives the unit, when closed, ergonomic characteristics that facilitate its manual use, fully adapting itself to the hollow of the hand.

Inside the support arm (5), which has a fluted (or U-shaped) cross section, the mechanism of the graduated point of support is located, which allows the user, at will, to situate the successive points of support provided.

The mechanism that constitutes the essential nature of the corkscrew that is the object of the present invention consists of two rockers, the first of which (13) is located in the upper part of the hollow part of the arm (5), attached to and tilting around a supporting axis (14). This first rocker (13) has inside a flat side (15) terminating at its lower end in the shape of a claw (16), which constitutes the point of support proper. This rocker is completed by an expansion spring (17), one of whose ends rests against the inner side of the arm (5), and the other against the inside of the flat side (15) of the rocker itself (13), while the spring (17) is coiled around the supporting axis (14).

The second rocker (18), similar to the first, is located in the lower part of the hollow area of the same arm (5), attached to and tilting around another supporting axis (19), its inner edge resting against the inner side of the arm (5) and its flat side (20) resting against the lower part of the rocker (13), with its end in the form of a claw (21) projecting from the edge of the arm (5) and constituting the second point of support. The rockers (13) and (18) allow the user, at will, to have two intermediate points of support.

Figure 2:
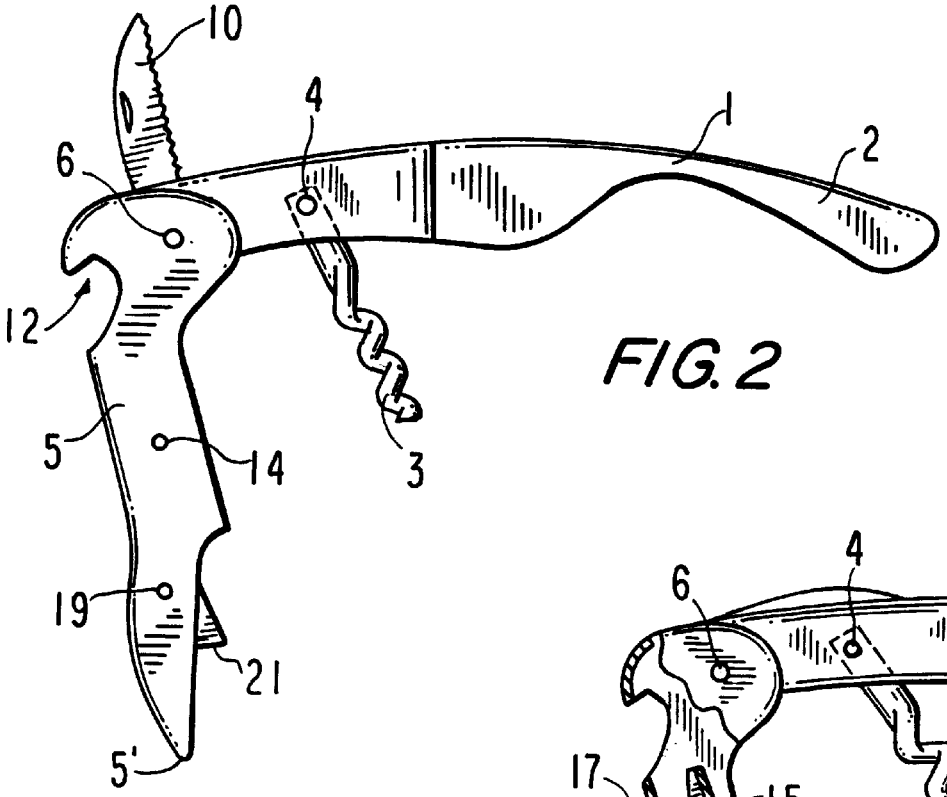
FIG. 2 is a side view of the same corkscrew, open and ready to perform its function.
Figure 3:
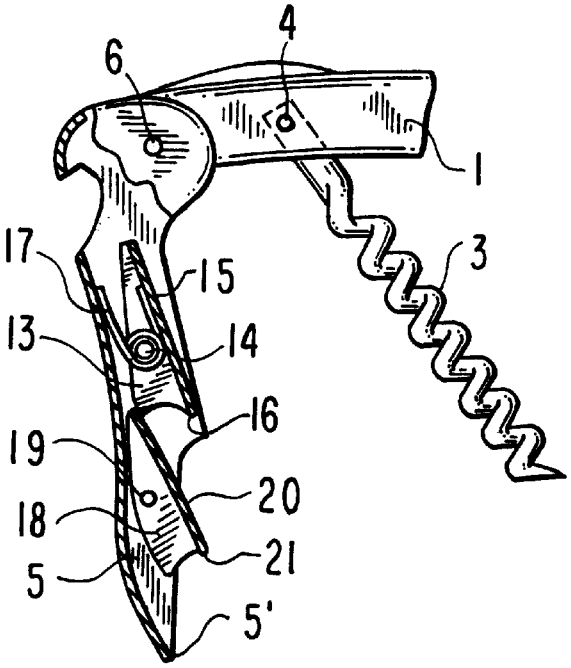
FIG. 3 is a partial view, duly semi-sectioned, showing the mechanism that constitutes the graduated point of support.

The group made up of the two rockers (13) and (18), as may be observed in FIGS. 2, 3 and 4, stays in its initial position, in the following manner:

The upper rocker (13), is concealed inside the arm (5) by the action of the spring (17), while the lower claw (21) of the other rocker (19) is visible projecting towards the outside.

When the stopper (11) extraction operation begins, and once the "ringlet" (3) has been introduced into the stopper, as FIGS. 4 and 5 illustrate, the user moves the arm (5) forcefully towards the bottle (9), in such a way that the projecting claw (21) presses against the mouth (8) of the bottle, withdrawing inward in accordance with the arrow (21') and causing, in turn and automatically, the movement of the upper rocker (13) in accordance with the arrow (13'), until its lower claw (16) projects, so that it rests against the flange (7) allowing the first action of the lever to initially extract a section of the stopper (11).

Immediately, as shown in FIG. 6, when the arm (5) separates from the bottle (9), the rocker (19) ceases to act upon the upper rocker (13), so that the latter withdraws inward by the action of the said spring (17), and at this moment the main arm (2) proceeds to rise, as shown in FIG. 7, until the claw (21) of the lower rocker (19) rests upon the flange (7) of the mouth (8), as FIG. 7 illustrates, allowing a second action of the lever to be carried out in order to extract the stopper (11) completely. If necessary a third action may be carried out by resting the pointed lower end (5') of the arm (5) upon the flange (7) and repeating the lever action to raise the main arm (2) further.

The successive raising of the support arm (5) upon the side of the mouth (8) with the purpose, described hereinbefore, of finding a progressive point of support in the claws (16) and (21) of the respective rockers, as FIGS. 4 and 7 illustrate, is facilitated by the inner edge of the said arm, which is slightly curved, allowing a perfect sliding without any hindrance that might make this movement difficult.

The object of the present invention having been sufficiently described, it should be pointed out that any variation in external forms, dimensions, finishing and quality of the materials used in the practical embodiment of the corkscrew do not alter the essential nature of the same, which is summarized in the following claims.

What is claimed is:

1. A manually operated corkscrew for removing a stopper from a mouth of a bottle, comprising:

a body;

a support arm pivotally connected to the body, the support arm having an edge;

a ringlet, for removable insertion into the stopper, pivotally connected to the body adjacent to where the body and the support arm are pivotally connected;

means pivotally connected with said support arm and providing separately at least two intermediate support points along the edge of the support arm for engagement with the mouth of the bottle to permit removal of the stopper without having to further insert the ringlet into the stopper.

2. The corkscrew of claim 1, wherein the means comprises:

a first rocker pivotally connected to the support arm adjacent to where the body and support arm are pivotally connected, a lower end having a first claw disposed thereon; and a second rocker pivotally connected to the support arm adjacent to where the first rocker is pivotally connected to the support arm, the second rocker having an upper and a lower end, the lower end having a second claw disposed thereon and the upper end being in contact with the lower end of the first rocker, wherein the second claw is biased to protrude from the edge of the support arm until the second claw is pressed against the bottle, whereupon the upper end of the second rocker acts upon the lower end of the first rocker to expose the first claw from the edge of the support arm.

3. The corkscrew of claim 2, further comprising:

a spring coiled around the point where the first rocker is pivotally connected to the support arm (1) and biasing the first rocker to expose the first claw from the edge of the support arm.

4. The corkscrew of claim 2, further comprising:

a third claw at an end of the support arm, which provides a further point of engagement with the mouth of the bottle for removal of the stopper.

5. A manually operated corkscrew for removing a stopper from a mouth of a bottle, comprising a body; a support arm pivotably connected to the body and having an edge; a ringlet removably insertable into the stopper and pivotably connected to the body adjacent to where the body and the support arm are pivotably connected; a first rocker pivotably connected to the support arm adjacent to where the body and the support arm are pivotably connected and having a lower end with a first claw; and a second rocker pivotably connected to the support arm adjacent to where the first rocker is pivotably connected to the support arm and having a lower end with a second claw and an upper end in contact with the lower end of the first rocker, said second claw being biased to protrude from the edge of the support arm until the second claw is pressed against the bottle, whereupon the upper end of the second rocker acts upon the lower end of the first rocker to expose the first claw from the edge of the support arm, and the rockers provide two intermediate support points along the edge of the support arm for engagement with the mouth of the bottle to permit removal of the stopper without having to further insert the ringlet into the stopper.

* * * * *